US010194709B1

(12) United States Patent
Jones et al.

(10) Patent No.: US 10,194,709 B1
(45) Date of Patent: Feb. 5, 2019

(54) ATHLETIC CAP SYSTEM

(71) Applicants: Anthony B. Jones, Tampa, FL (US); Latilia J. Jones, Tampa, FL (US)

(72) Inventors: Anthony B. Jones, Tampa, FL (US); Latilia J. Jones, Tampa, FL (US)

( * ) Notice: Subject to any disclaimer, the term of this patent is extended or adjusted under 35 U.S.C. 154(b) by 137 days.

(21) Appl. No.: 15/462,416

(22) Filed: Mar. 17, 2017

(51) Int. Cl.

| | |
|---|---|
| ***A42B 1/04*** | (2006.01) |
| ***A42B 1/06*** | (2006.01) |
| ***A42B 1/00*** | (2006.01) |
| ***A47K 10/02*** | (2006.01) |
| ***A42B 1/22*** | (2006.01) |

(52) U.S. Cl.
CPC ..... *A42B 1/066* (2013.01); *A42B 1/004* (2013.01); *A42B 1/006* (2013.01); *A42B 1/225* (2013.01); *A47K 10/02* (2013.01)

(58) Field of Classification Search
CPC ..... A42B 1/066; A42B 1/004; A42B 1/006; A42B 1/225; A47K 10/02
See application file for complete search history.

(56) References Cited

U.S. PATENT DOCUMENTS

| | | | | |
|---|---|---|---|---|
| 1,261,073 A * | 4/1918 | Van Raalte | ..... | A42B 1/041 2/207 |
| D113,773 S * | 3/1939 | Tull | ..... | D2/861 |
| 2,698,944 A * | 1/1955 | Ramsby | ..... | A41D 15/00 2/174 |

* cited by examiner

*Primary Examiner* — Anna K Kinsaul

(57) ABSTRACT

A generally rectangular shade flap has a lower edge, an upper edge, a left side edge, and a right side edge. A generally circular opening extends through the shade flap and is spaced from the upper edge by a front distance thereby creating a forward section. A generally cylindrical headband has an upper end and a lower end separated by a height. The lower end of the headband is coupled to the shade flap adjacent to the circular opening.

1 Claim, 4 Drawing Sheets

ATHLETIC CAP SYSTEM

BACKGROUND OF THE INVENTION

Field of the Invention

The present invention relates to an athletic cap system and more particularly for functioning as a cap while covering portions of a wearer's head including the forehead, back of the neck and sides of the face and also functioning as a towel. The functioning both as a cap and as a towel is done in a comfortable, attractive, convenient, and economical manner.

Description of the Prior Art

The use of athletic cap systems of known designs and configurations is known in the prior art. More specifically, athletic cap systems of known designs and configurations previously devised and utilized for the purpose of covering portions of a head of a user and providing sun protection are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe an athletic cap system that functions as a cap while covering portions of a wearer's head including the forehead, back of the neck and sides of the face and also functions as a towel. The functioning both as a cap and as a towel is done in a comfortable, attractive, convenient, and economical manner.

In this respect, the athletic cap system according to the present invention substantially departs from the conventional concepts and designs of the prior art, and in doing so provides an apparatus primarily developed for functioning as a cap while covering portions of a wearer's head including the forehead, back of the neck and sides of the face and also functioning as a towel. The functioning both as a cap and as a towel is done in a comfortable, attractive, convenient, and economical manner.

Therefore, it can be appreciated that there exists a continuing need for a new and improved athletic cap-system which can be function as a cap while covering portions of a wearer's head including the forehead, back of the neck and sides of the face and also function as a towel. The functioning both as a cap and as a towel is done in a comfortable, attractive, convenient, and economical manner. In this regard, the present invention substantially fulfills this need.

SUMMARY OF THE INVENTION

In view of the foregoing disadvantages inherent in the known types of athletic cap systems of known designs and configurations now present in the prior art, the present invention provides an improved athletic cap system. As such, the general purpose of the present invention, which will be described subsequently in greater detail, is to provide a new and improved athletic cap system and method which has all the advantages of the prior art and none of the disadvantages.

To attain this, the present invention essentially comprises an athletic cap system having a shade flap in a generally rectangular configuration with a lower edge, an upper edge, a left side edge, and a right side edge. An opening extends through the shade flap. The opening is in a generally circular configuration and is spaced from the upper edge by a front distance thereby creating a forward section. A headband in a generally cylindrical configuration has an upper end and a lower end separated by a height. The lower end of the headband is coupled to the shade flap adjacent to the opening.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved athletic cap system which has all of the advantages of the prior art athletic cap systems of known designs and configurations and none of the disadvantages.

It is another object of the present invention to provide a new and improved athletic cap system which may be easily and efficiently manufactured and marketed.

It is a further object of the present invention to provide a new and improved athletic cap system which is of durable and reliable constructions.

An even further object of the present invention is to provide a new and improved athletic cap system which is susceptible of a low cost of manufacture with regard to both materials and labor, and which accordingly is then susceptible of low prices of sale to the consuming public, thereby making such athletic cap system economically available to the buying public.

Lastly, it is an object of the present invention to provide a new and improved athletic cap system functioning as a cap while covering portions of a wearer's head including the forehead, back of the neck and sides of the face and also functioning as a towel. The functioning both as a cap and as a towel is done in a comfortable, attractive, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
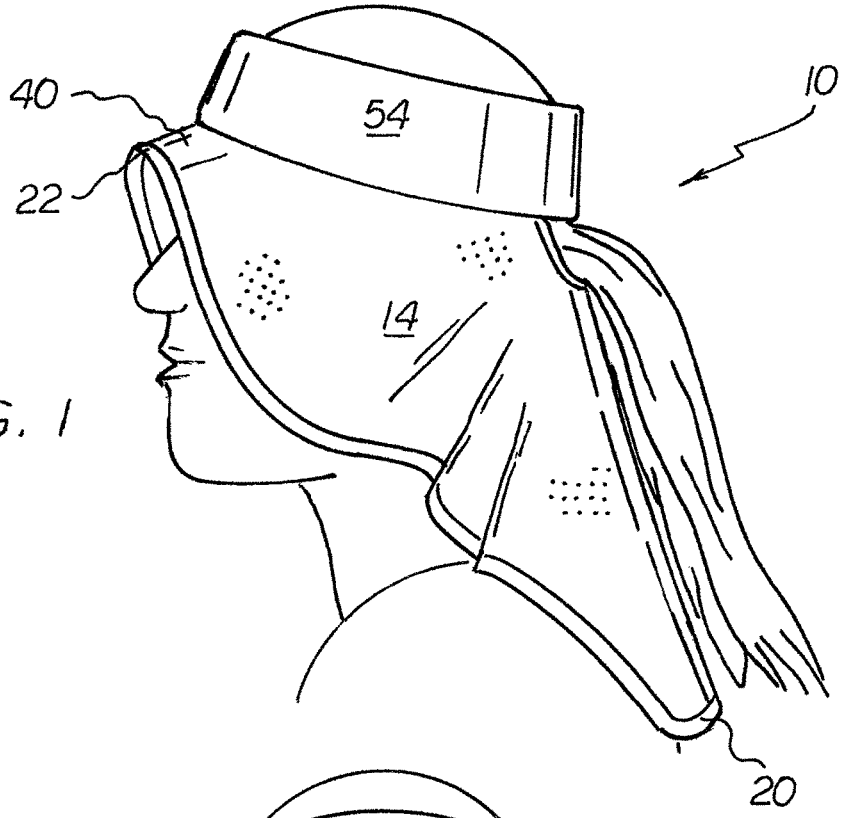
FIG. 1 is a side elevational view of an athletic cap system constructed in accordance with the principles of the present invention.
Figure 2:
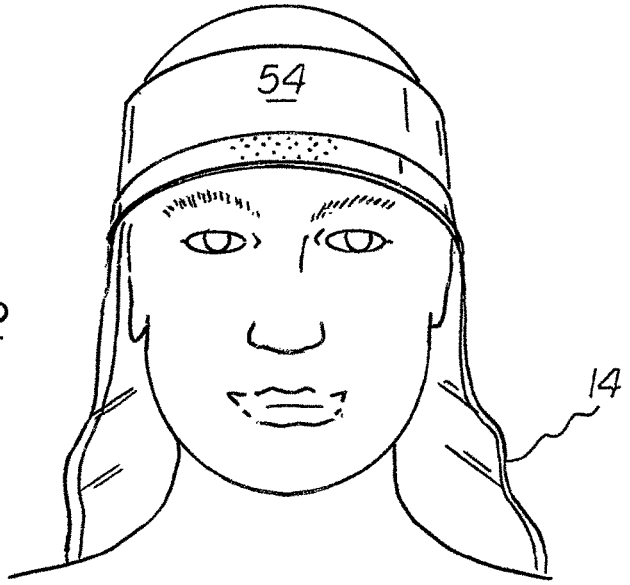
FIG. 2 is a front elevational view of the system shown in FIG. 1.
Figure 3:
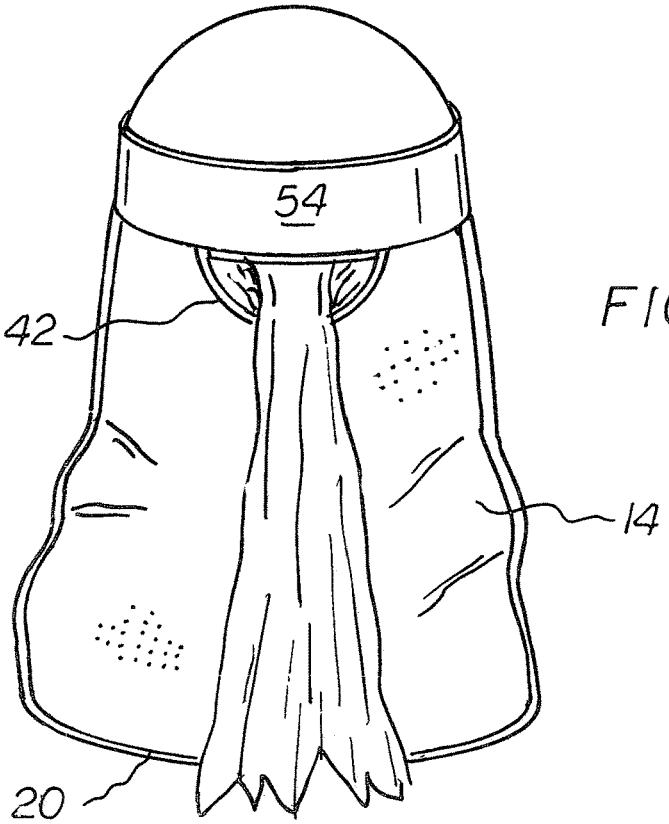
FIG. 3 is a rear elevational view of the system shown in FIGS. 1 and 2.
Figure 4:
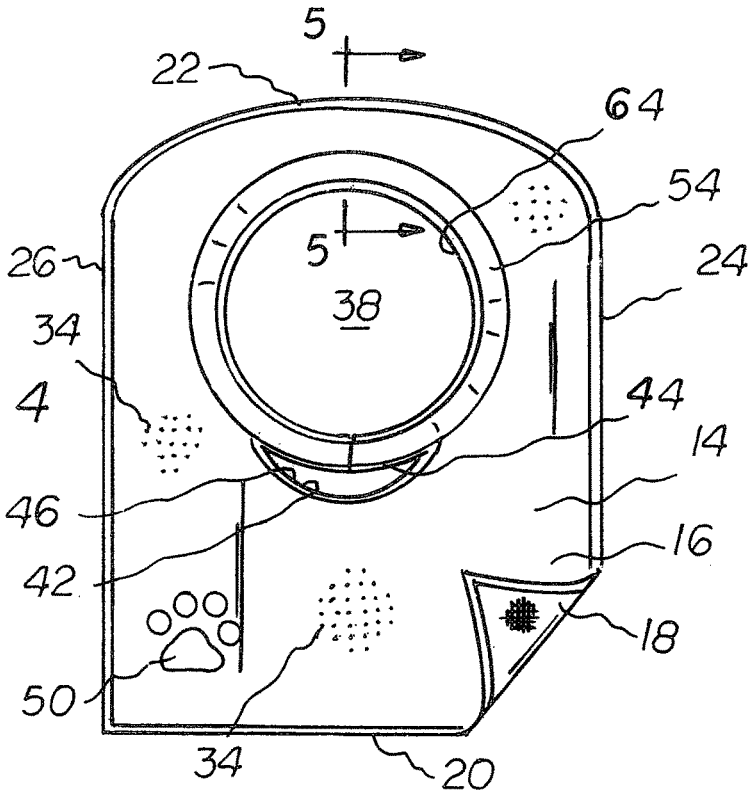
FIG. 4 is a plan view of the shade flap illustrated in the prior Figures.
Figure 5:
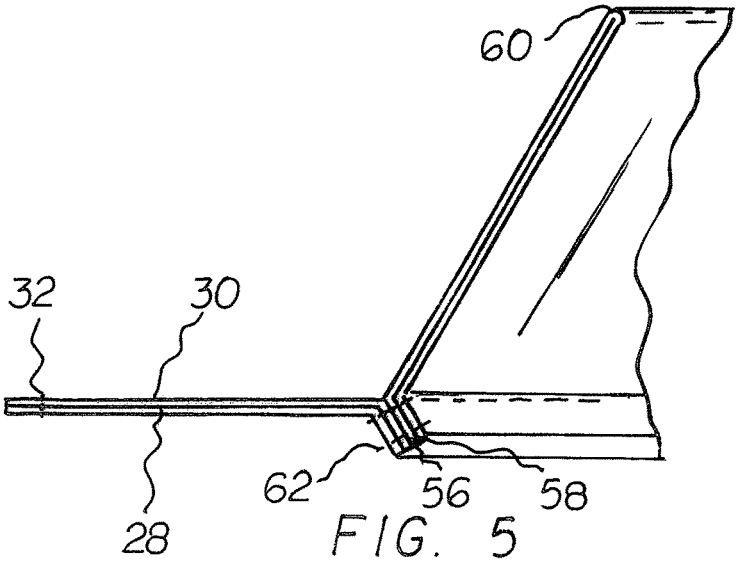
FIG. 5 is a cross sectional view taken along line 5-5 of FIG. 4.

With reference now to the drawings, and in particular to FIG. 1 thereof, the preferred embodiment of the new and improved athletic cap system embodying the principles and concepts of the present invention and generally designated by the reference numeral 10 will be described.

The present invention, the athletic cap system 10 is comprised of a plurality of components. Such components in their broadest context include a shade flap, an opening in the shade flap, and a headband. Such components are individually configured and correlated with respect to each other so as to attain the desired objective.

The athletic cap system functions as a cap while covering portions of a head of a wearer including the forehead, back of the neck, and sides of a face. It also functions as a towel. The functioning both as a cap and as a towel is done in a comfortable, attractive, convenient and economical manner. In the preferred embodiment of the athletic cap system 10, first provided is a shade flap 14. The shade flap is in a generally rectangular configuration. The shade flap has an inner surface 16, an outer surface 18, a lower edge 20, and an arcuate upper edge 22. The shade flap has a height. The shade flap has a linear left side edge 24 and a parallel linear right side edge 26 separated by a width. The shade flap has an interior layer 28 and a similarly configured exterior layer 30. The shade flap has a periphery. Overcast exterior stitching 32 is provided around the periphery coupling the interior layer and the exterior layer. The exterior layer is fabricated of 100 percent polyester fabric with an array of small apertures 34. The interior layer is fabricated of 10 percent spandex and 90 percent polyester fabric for greater elasticity than the exterior layer.

Next provided is an opening 38. The opening extends through the shade flap. The opening is in a generally circular configuration with a diameter. The diameter is between 25 and 50 percent of the height. The opening has a horizontal axis and a vertical axis. The opening is spaced from the upper edge by a front distance thereby creating a forward section 40 between the opening and the upper edge and a rearward section between the opening and the lower edge. A recess 42 in the opening extends downwardly to form a major portion 44 of the opening above and a minor portion 46 of the opening below.

Next provided is indicia 50 on the rearward section of the exterior surface of the exterior layer. The indicia may be sports logos, school indicia, animals, business indicia, and the like.

Next provided is a headband 54. The headband is in a generally cylindrical configuration. The headband has a first free end 56. The headband also has a second free end 58 overlying the first free end thereby forming a fold 60 equally spaced from the first free end and the second free end. Overcast interior stitching 62 is provided coupling the shade flap in the major portion to the first free edge and the second free edge. Additional overcast stitching 64 in the minor portion is provided coupling together the free ends of the headband and in the minor portion coupling together the interior and exterior layers of the shade flap. A ponytail opening is formed between the recess and the headband. The headband has a headband height between the fold and the overcast interior stitching. The headband height is greater than the front distance.

The shade flap is adapted to expand and then contract around the head of the wearer for securement purposes while being worn with the short section forwardly over the forehead of the wearer, the long section rearwardly over the back of the neck of the wearer, and with intermediate sections in contact with the sides of the face of the wearer. In this manner, the shade flap protects the head, the forehead, the neck, and the sides of the face of the wearer from ultraviolet rays of the sun.

Figure 6:
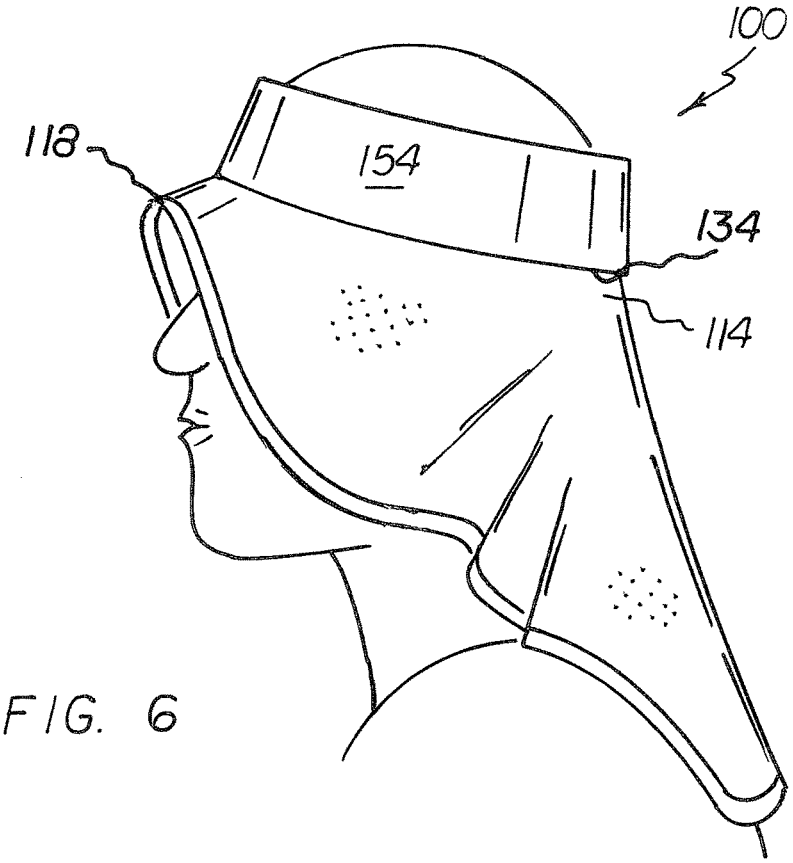
FIG. 6 is a side elevational view similar to FIG. 1 but illustrating an alternate embodiment of the invention without a ponytail opening.
Figure 7:
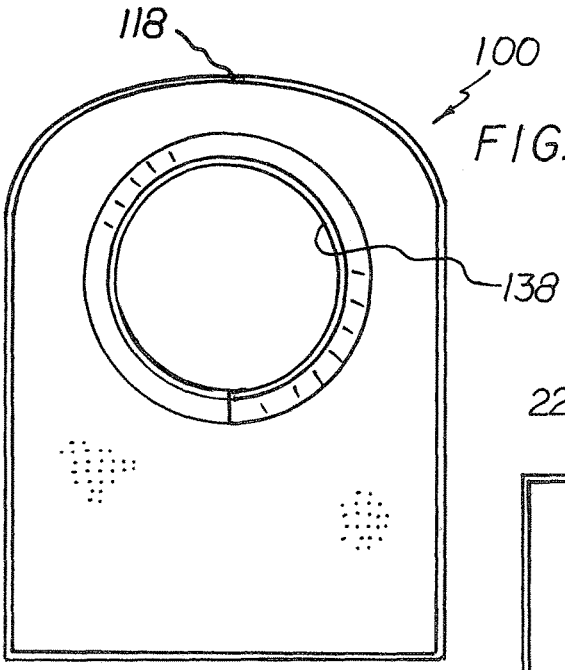
FIG. 7 is a plan view of the shade flap of FIG. 6.

An alternate embodiment of the system 100 is shown in FIGS. 6 and 7. In this embodiment, the opening is circular and the headband 134 is attached entirely around the shade flap 114. Also, the upper edge 118 is arcuate and the opening is circular.

Figure 8:
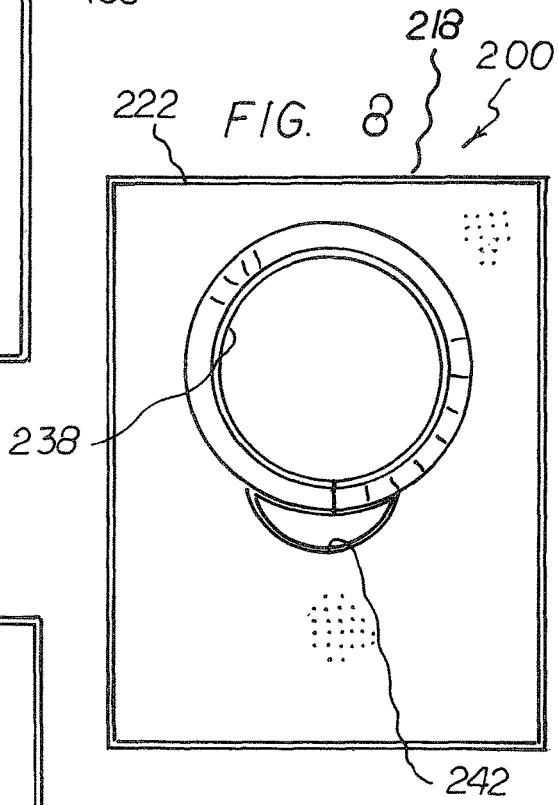
FIG. 8 is a plan view of a shade flap illustrating another alternate embodiment of the invention.

Another alternate embodiment of the system 200 is shown in FIG. 8. In this embodiment, the upper edge 218 is arcuate and the opening 238 is generally circular but includes a recess 242.

Figure 9:
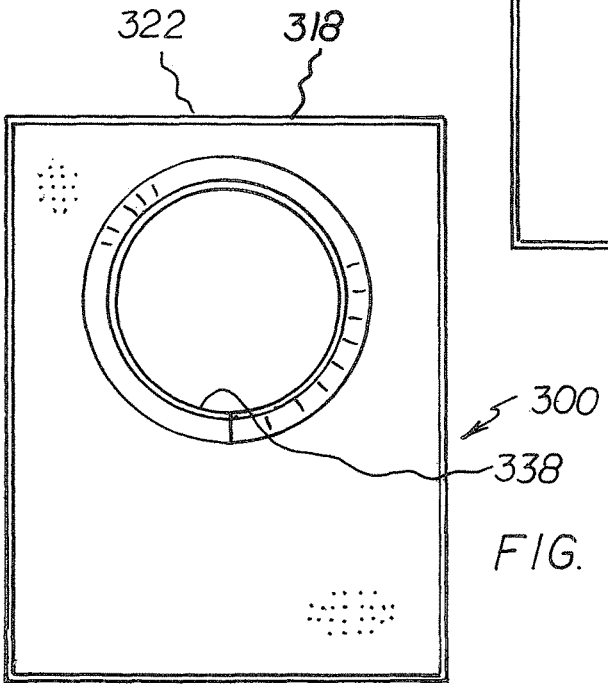
FIG. 9 is a plan view of a shade flap illustrating another alternate embodiment of the invention.

A final alternate embodiment of the system 300 is shown in FIG. 9. In this embodiment, the upper edge 318 is arcuate and the opening 338 is circular.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An athletic cap system for functioning as a cap while covering portions of a head of a wearer including a forehead and a back of a neck and sides of a face, and for functioning as a towel, the system comprising, in combination:

a shade flap being in a generally rectangular configuration, the shade flap having an inner surface and an outer surface and a lower edge and an arcuate upper edge, the shade flap having a height, the shade flap having a linear left side edge and a parallel linear right side edge separated by a width, the shade flap having an interior layer and a similarly configured exterior layer, the shade flap having a periphery, overcast exterior stitching around the periphery coupling the interior layer and the exterior layer, the exterior layer being fabricated of 100 percent polyester fabric with an array of small apertures, the interior layer being fabricated of 10 percent spandex and 90 percent polyester fabric for greater elasticity than the exterior layer;

an opening extending through the shade flap, the opening having a generally circular configuration with a diameter, the diameter being between 25 and 50 percent of the height, the opening having a horizontal axis and a vertical axis, the opening being spaced from the upper edge by a front distance thereby creating a forward section between the opening and the upper edge, a rearward section between the circular opening and the lower edge, a recess adjacent to the opening extending downwardly to form a major portion of the opening above and a minor portion of the opening below;

indicia on the rearward section of the outer surface of the exterior layer;

a headband in a generally cylindrical configuration, the headband having a first free end and a second free end overlying the first free end thereby forming a fold equally spaced from the first free end and the second free end, overcast interior stitching coupling the shade flap in the major portion to the first free edge and the second free edge, additional overcast stitching in the minor portion coupling together the free ends of the headband and in the minor portion coupling together the interior and exterior layers of the shade flap, a ponytail opening formed between the recess and the headband, the headband having a headband height between the fold and the overcast interior stitching, the headband height being greater than the front distance;

whereby the shade flap is adapted to expand and then contract around the head of the wearer for securement purposes while being worn with the rearward section constituting a short section forward over the forehead of the wearer and the rearward section constituting a long section rearwardly over the back of the neck of the wearer and with intermediate sections in contact with the sides of the face of the wearer with the shade flap protecting the head and forehead and neck and sides of the face of the wearer from ultraviolet rays of the sun.

* * * * *